US009068307B2

(12) United States Patent
Johnson et al.

(10) Patent No.: US 9,068,307 B2
(45) Date of Patent: Jun. 30, 2015

(54) PORTABLE VACUUM SYSTEM

(75) Inventors: Kenneth Douglas Johnson, Derby, KS (US); Mark D. McNeil, Winfield, KS (US)

(73) Assignee: Winfield Consumer Products, Inc., Winfield, KS (US)

( * ) Notice: Subject to any disclaimer, the term of this patent is extended or adjusted under 35 U.S.C. 154(b) by 307 days.

(21) Appl. No.: 13/480,872

(22) Filed: May 25, 2012

(65) Prior Publication Data

US 2013/0312214 A1 Nov. 28, 2013

(51) Int. Cl.
*A47L 5/00* (2006.01)
*E01H 1/00* (2006.01)

(52) U.S. Cl.
CPC ..... *E01H 1/006* (2013.01)

(58) Field of Classification Search
USPC ..... 15/354, 347, 353, 339; 280/510, 638, 280/656, 789
See application file for complete search history.

(56) References Cited

U.S. PATENT DOCUMENTS

| | | | | | |
|---|---|---|---|---|---|
| 3,995,754 | A * | 12/1976 | DeKoning | 414/523 |
| 4,199,837 | A * | 4/1980 | Fisco, Jr. | 15/302 |
| 4,218,226 | A * | 8/1980 | Boozer | 96/414 |
| 5,218,737 | A * | 6/1993 | Dansby et al. | 15/347 |
| 6,389,641 | B1 * | 5/2002 | Boomgaarden et al. | 15/340.1 |
| 7,323,022 | B1 * | 1/2008 | Redlin | 55/319 |
| 2007/0136983 | A1 * | 6/2007 | Oberhofer et al. | 15/330 |

* cited by examiner

*Primary Examiner* — Dung Van Nguyen
(74) *Attorney, Agent, or Firm* — Westman, Champlin & Koehler, P.A.; Theodore M. Magee

(57) ABSTRACT

Portable vacuum systems are provided. In one embodiment, a portable vacuum system includes a tank, an engine, and a transportation system. The engine is configured to generate a vacuum within the tank. The transportation system illustratively has one or more wheels and is configured to tilt the tank about an axis that is between a front and a back of the tank. In other embodiments, a portable vacuum system may also include a swivel elbow that connects the tank to a vacuum wand, a ledge that supports the engine, a back door that forms a seal with the tank along a curved lip, and a filter that is accessible through a threaded cover on the tank. Additionally, one or more of the components of a system may be made utilizing rotational molding.

18 Claims, 9 Drawing Sheets

100

PORTABLE VACUUM SYSTEM

BACKGROUND

Vacuum systems are commonly used to collect materials. For example, a vacuum system may be used to collect animal waste into a tank. The tank can be portable such that once the material is collected that it can be transported to a different location and emptied. For instance, the tank may be on wheels and have a door that enables the contents to be removed from the inside of the tank. Certain embodiments of the present disclosure may be used in settings such as, but not limited to, animal waste collection. However, it should be understood that embodiments of the present disclosure are not limited to any particular setting and may be used in other applications as well.

SUMMARY

An aspect of the disclosure relates to portable vacuum systems. In one embodiment, a portable vacuum system includes a tank, an engine, and a transportation system. The engine is configured to generate a vacuum within the tank. The transportation system illustratively has one or more wheels and is configured to tilt the tank about an axis that is between a front and a back of the tank. In other embodiments, a portable vacuum system may also include a swivel elbow that connects the tank to a vacuum wand, a ledge that supports the engine, a back door that forms a seal with the tank along a curved lip, and a filter that is accessible through a threaded cover on the tank. Additionally, one or more of the components of a system may be made utilizing rotational molding.

These and various other features and advantages that characterize the claimed embodiments will become apparent upon reading the following detailed description and upon reviewing the associated drawings.

EF DESCRIPTION OF THE DRAWINGS

FIGS. 6-1 and 6-2 are perspective views of portions of a clamp ring.

DETAILED DESCRIPTION

Figure 1:
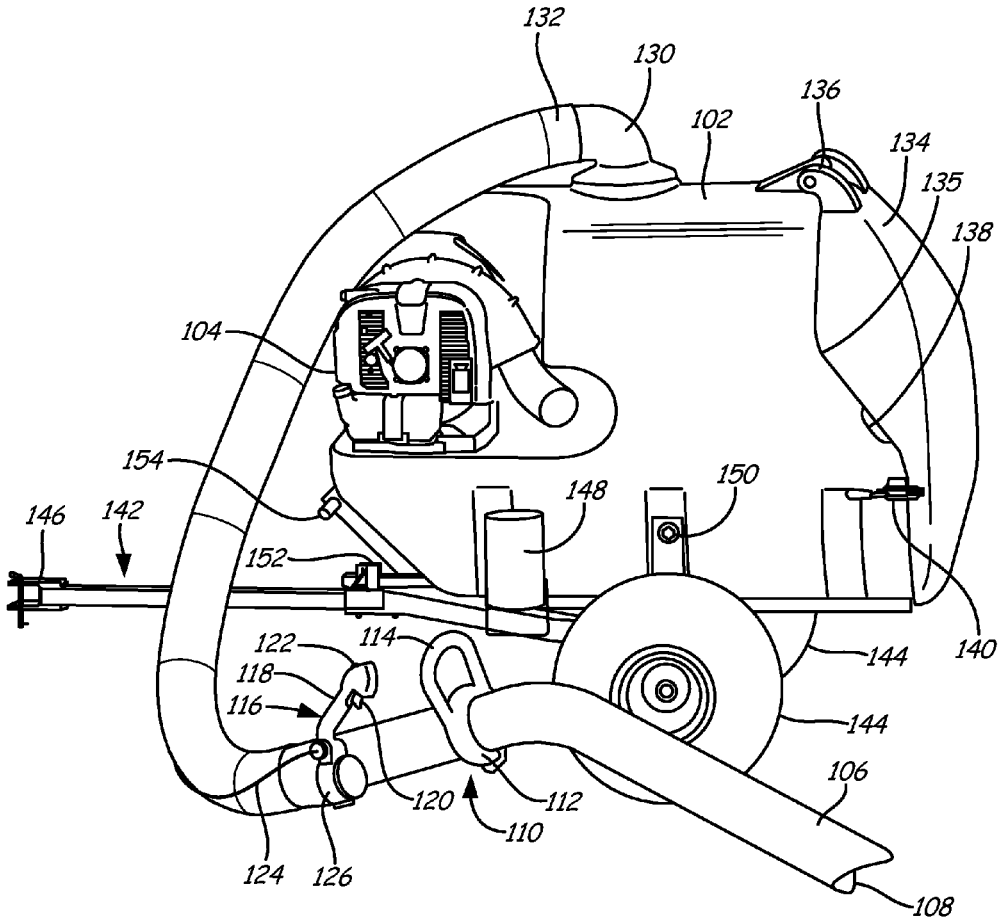
FIG. 1 is a side view of a portable vacuum system from the engine side.

Embodiments of the present disclosure include portable vacuum systems. FIG. 1 shows a side view of one example of a portable vacuum system 100. System 100 has a collection tank 102 and an engine 104. In one embodiment, engine 104 is utilized to create a vacuum within tank 102. System 100 further optionally includes a vacuum wand 106 having an opening 108 that is in fluid communication with the inside of tank 102. In an embodiment, an operator is able to collect materials within tank 102 by placing the opening 108 of the vacuum wand 106 in proximity to the material to be collected.

For example, in a situation in which system 100 is utilized to collect animal waste, vacuum wand 106 is placed over the animal waste and it is vacuumed up into the tank 102. Obviously, however, system 100 is not limited to any particular setting and can be used in applications other than animal waste collection.

A handle assembly 110 is optionally attached to vacuum wand 106. Handle assembly 110 may include an attachment portion 112 and a gripping portion 114. As shown in the figure, gripping portion 114 is connected to attachment portion 112 and provides a surface for an operator to hold onto. For instance, an operator can hold onto and control the direction of vacuum wand 106 by placing a hand around gripping portion 114. Therefore, an operator can control what is being vacuumed into tank 102 utilizing handle assembly 110.

The attachment portion 112 of handle assembly 110 illustratively includes an aperture (e.g. a circular aperture) that surrounds vacuum wand 106. The aperture of the attachment portion 112 can fit around and be secured to vacuum wand 106 utilizing a clamping mechanism. Embodiments of attachment portions 112 are not however limited to any particular configuration, and can be attached to vacuum wand 106 utilizing other mechanisms (e.g. screws, adhesives, etc.).

Vacuum system 100 also illustratively includes an engine controller 116. Engine controller 116 may include a handle portion 118, a trigger button 120, a top button 122, a wire 124, and an attachment mechanism 126. In an embodiment, engine controller 116 is used to control some of the functioning of engine 104. For instance, in one particular example, trigger button 120 controls the engine speed (e.g. acceleration and/or deceleration), and top button 122 enables a user to turn the engine off. Embodiments are not however limited to any particular buttons or use of buttons. The positions of any included buttons (e.g. buttons 120 and 122) are illustratively relayed to the engine using wire 124. Additionally, the handle assembly 116 may be attached to the vacuum wand 106 utilizing a clamping or other attachment mechanism 126.

In one embodiment, vacuum wand 106 is connected to tank 102 utilizing a flexible tube 128 and a swivel elbow 130. The flexible tube 128 may be attached to swivel elbow 130 utilizing a clamp 132. Swivel elbow 130 is illustratively rotatable relative to tank 102. This enables vacuum wand 106 and flexible tube 128 to be rotated relative to tank 102 without causing any bends or pinches that may impede the flow of air from vacuum wand 106 to tank 102. Additionally, the swivel elbow 130 may in certain situations make it easier for an operator to control the positioning of vacuum wand 106.

Engine 104 is in one embodiment a 63.3 cubic centimeter 2-stroke engine. However, embodiments of engine 104 are not limited to any particular type of engine and may include any type of engine (e.g. gas, electric, etc.). Engine 104 optionally includes an air-intake portion that is fluidly connected to the inside volume of tank 102. Engine 104 is then able to generate a vacuum within tank 102 by removing air from the tank. Furthermore, it should be highlighted that the outside surface of tank 102 is configured such that engine 104 fits within a space cut-out from tank 102 and does not protrude from the tank. Accordingly, engine 104 is less likely to get caught on anything, and the entire vacuum system 100 is able to easily move through narrow pathways. For example, in one embodiment, system 100 is designed to fit through a standard 48 inch wide pathway.

Tank 102 in one embodiment includes a door 134. Door 134 illustratively forms an airtight seal with tank 102 such that air does enter tank 102 from around the door 134 when a vacuum is formed within tank 102. Door 134 is optionally attached to tank 102 utilizing a hinge 136. Accordingly, door 134 is able to be rotated up and down along the hinge 136 to open and close the tank 102. For example, an operator could access the contents of tank 102 by opening door 134 upward using hinge 136. As can be seen in the figure, door 134 includes a curved lip 135 that meets with the opening of tank 102. The curved lip in certain situations may be useful in enabling an operator to see more of the inside of tank 102.

System 100 may also include one or more recessed access portions 138 and one or more latches 140. In an embodiment, recessed access portion 138 provides a space for a person to grip a portion of door 134, so that it can be opened. For instance, an operator could fit a finger within portion 138 to open door 134. Furthermore, the one or more latches 140 can be used by an operator to either open or close the door 134. It should be noted that embodiments of the present disclosure are not limited to any particular configuration of door 134, hinge 136, or latches 140, and that the specific examples shown in the figures are for illustration purposes only.

Tank 102 is illustratively supported by a portable frame 142. Frame 142 may include one or more wheels 144 and a hitch 146. An operator can attach vacuum system 100 to a moveable device such as, but not limited to, a tractor, an all-terrain vehicle, a riding lawn mower, etc. using hitch 146. Accordingly, vacuum system 100 is portable in that it can be moved about from one position to the next.

Frame 102 optionally includes a vacuum wand holder 148 and one or more attachment mechanisms 150. In an embodiment, vacuum wand holder 148 holds vacuum wand 106 in place during transportation, storage, etc. For example, the round outer surface of vacuum wand 106 is illustratively sized such that it fits within an aperture of holder 148. Accordingly, wand 106 can be placed in holder 148. Attachment mechanisms 150 illustratively include one or more bolts, screws, etc. that can be placed through tank 102 to hold tank 102 to frame 142. In an embodiment, two attachment mechanisms 150 are placed on opposite sides of tank 102. As well as holding tank 102 to frame 142, attachment mechanisms 150 may also be useful in that they help to prevent tank 102 from collapsing under the pressure of the vacuum created within the tank. Accordingly, attachment mechanisms 150 may be useful for both holding tank 102 to frame 142 and for maintaining the shape of tank 102 when there is a vacuum within the tank. Additionally, attachment mechanisms 150 can act as a pivot point between the upper and lower frames. The pivot point illustratively provides enough clearance such that contents of the tank can be emptied. The pivot point may also reduce an amount of force that is needed to empty the tank. Accordingly, the attachment mechanisms may serve several functions such as, but not limited to, acting as a pivot point, preventing collapsing of the tank, and acting as an attachment point. Embodiments are not however limited to any specific configuration, and embodiments may include configurations different than the specific one shown in the figure.

Frame 102 may also include a spring-loaded latch 152 and a T-bar 154. As will be described in greater detail below, tank 102 is illustratively tiltable relative to hitch 146. In one embodiment, spring-loaded latch 152 controls whether tank 102 is in an up or a down position. For instance, the tank may be held in a down position by the latch 152. Then, when an operator depresses latch 152, the tank is released into an up position. This can be useful for example in emptying tank 102. In such cases, the T-bar 154 may be useful in helping an operator tilt the tank 102. For example, an operator could pull the T-bar 154 up to move tank 102 into an up position to empty the tank 102, and then pull the T-bar 154 down to move tank 102 back into the down position.

Figure 2:
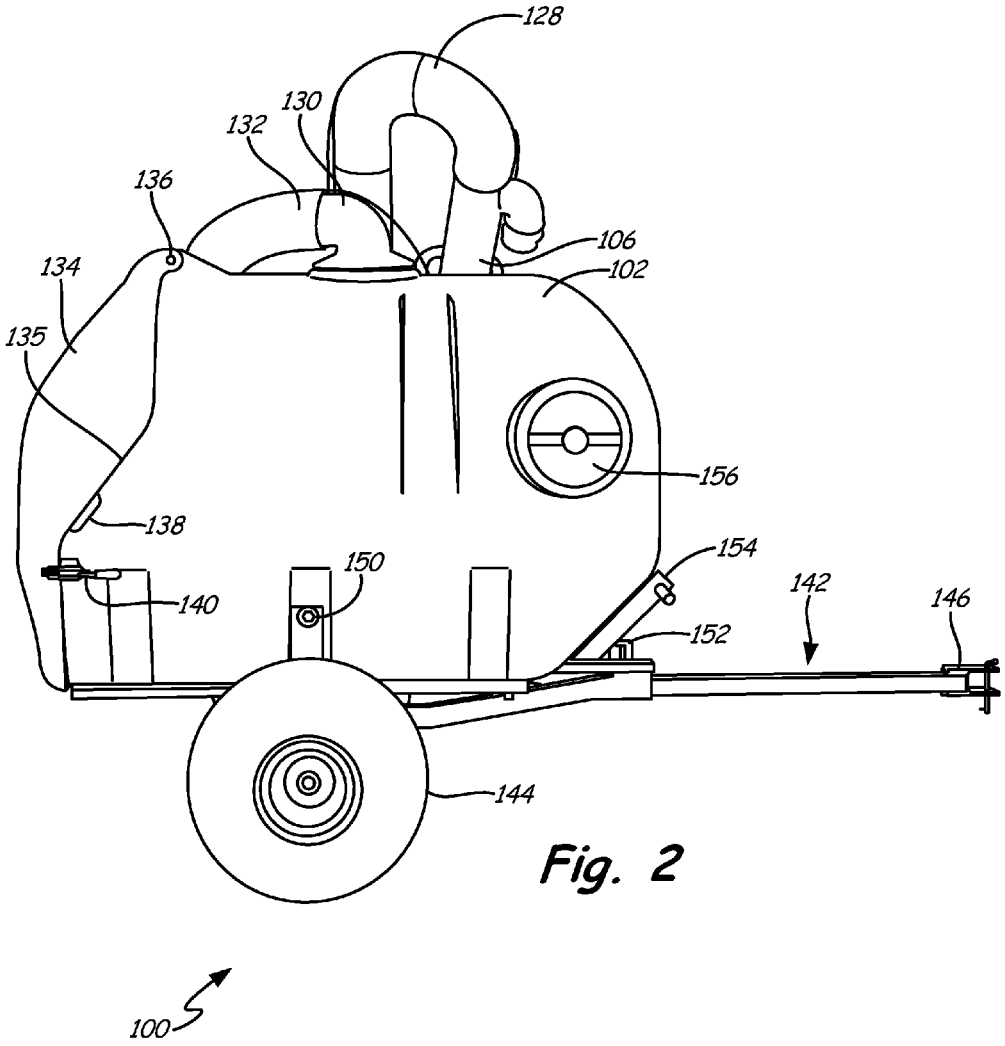
FIG. 2 is a side view of a portable vacuum system from the filter side.

FIG. 2 shows a side view of vacuum system 100 from the perspective of the opposite side of that shown in FIG. 1. Many of the components of system 100 shown in FIG. 1 are also shown in FIG. 2. The components are numbered the same in FIGS. 1 and 2, and in the rest of the drawings.

As can be seen in FIG. 2, the side of the tank 102 that is the opposite from engine 104 (shown and labeled in FIG. 1) does not include a cut-out portion for the engine. Instead, the shape of the tank 102 is consistent with surrounding areas to maximize the volume of the tank. It is worth mentioning that in one embodiment, the volume of the tank is 100 gallons or more. However, embodiments are not limited to any particular dimensions and embodiments of tank 102 can be larger or smaller than 100 gallons.

Tank 102 optionally includes a filter lid 156. Lid 156 is illustratively threaded and fits within a threaded aperture of tank 102. In an embodiment, an operator is able to access a filter by unscrewing lid 156 from tank 102.

Figure 3:
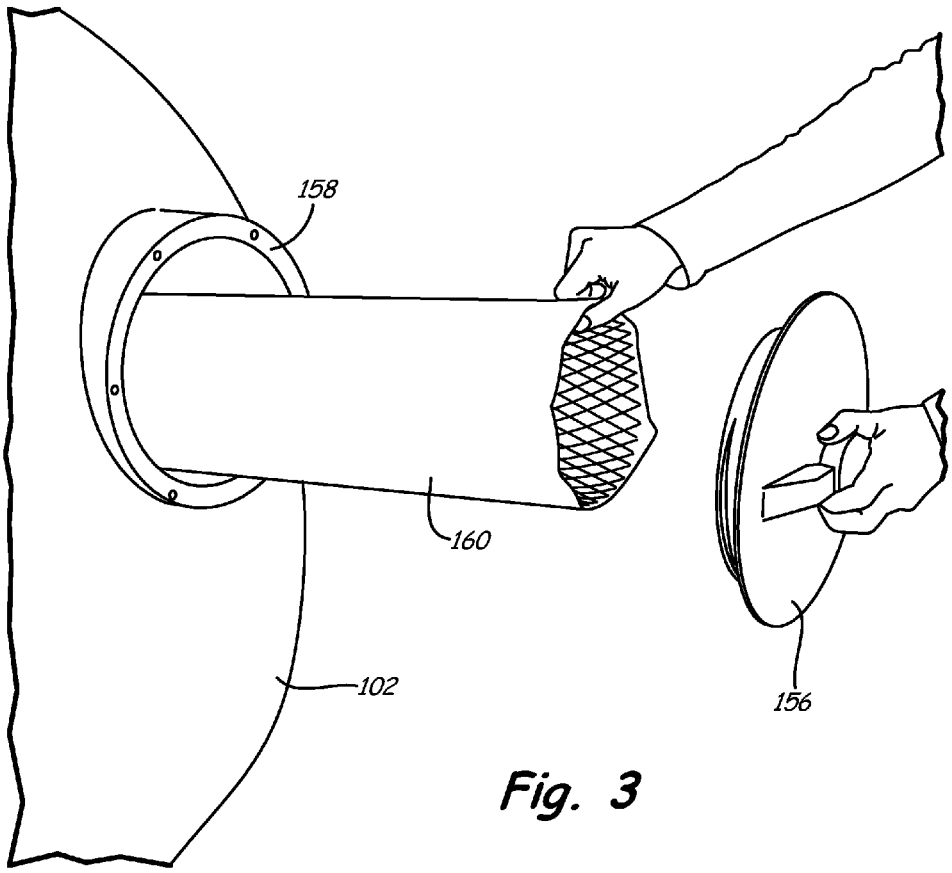
FIG. 3 is a perspective view of the filter being removed from a portable vacuum system.

FIG. 3 shows a perspective view of lid 156 being removed from a threaded aperture 158 of tank 102. FIG. 3 also shows a filter 160 being pulled out from the system. Filter 160 may be placed in this position to clean or repair the filter 160. The filter 160 normally however would be placed within tank 102 during operation of vacuum system 100. In one embodiment, for illustration purposes only and not by limitation, filter 160 covers an air inlet of engine 104 (shown and labeled in FIG. 1) such that large materials do not enter engine 104 as engine 104 creates a vacuum within tank 102. Embodiments are not however limited to any particular configuration and a filter 160 may be used for any purpose.

Figure 4:
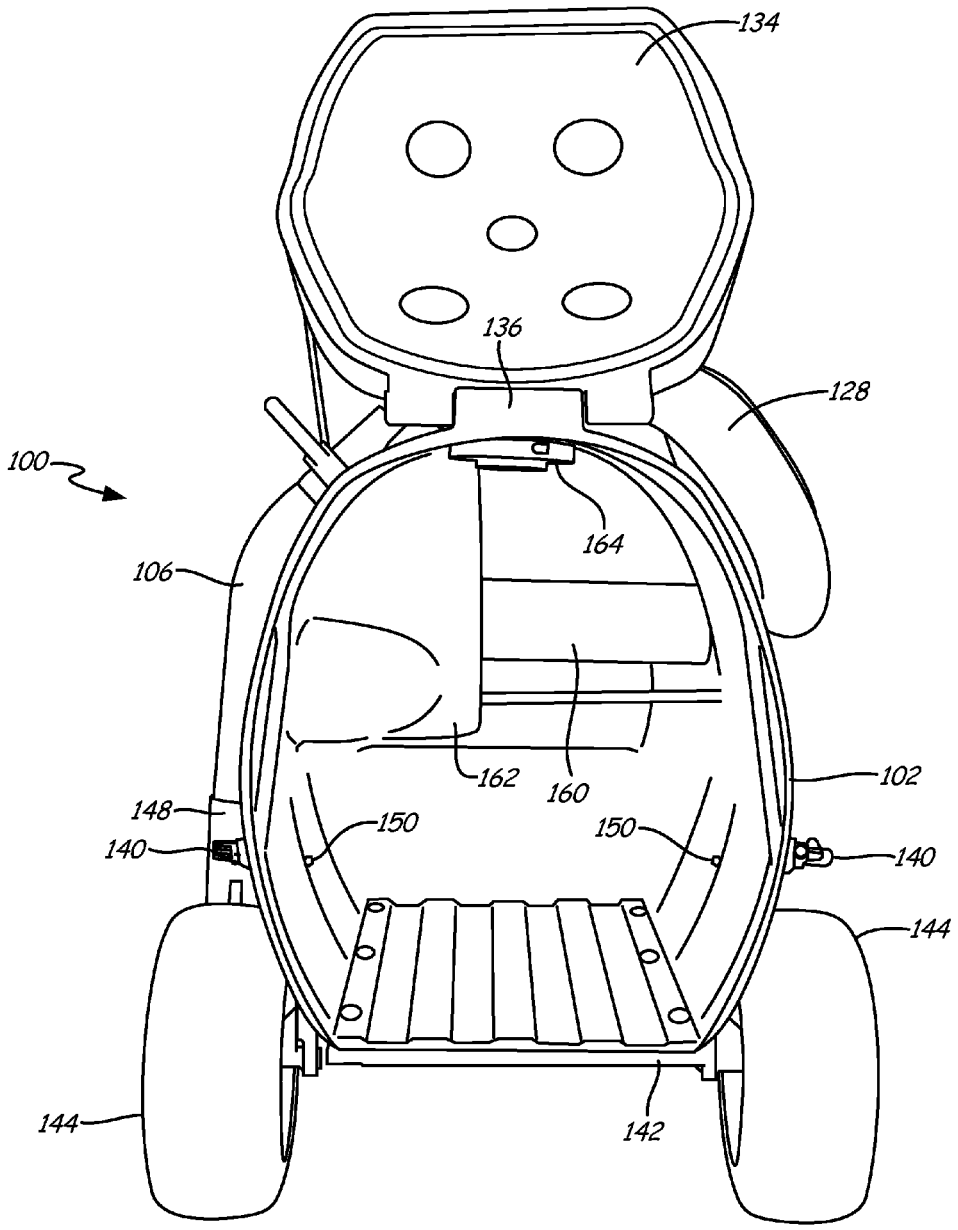
FIG. 4 is a back view of a portable vacuum system.

FIG. 4 is a back view of vacuum system 100 with door 134 in an open position. FIG. 4 shows a shelf or ledge portion 162 created within the volume of tank 102 that supports engine 104 (shown and labeled in FIG. 1). The figure also shows filter 160 extending across the width of tank 102 to reach the engine portion. Additionally, the figure shows that attachment mechanisms 150 that attach tank 102 to frame 142 extend all the way into the inside of tank 102. This can help to support tank 102 and to prevent tank 102 from collapsing under the pressure of the vacuum. Furthermore, FIG. 4 shows a clamp ring 164. Clamp ring 164 illustratively holds swivel elbow 130 (shown and labeled in FIGS. 1 and 2) in place.

Figure 5:
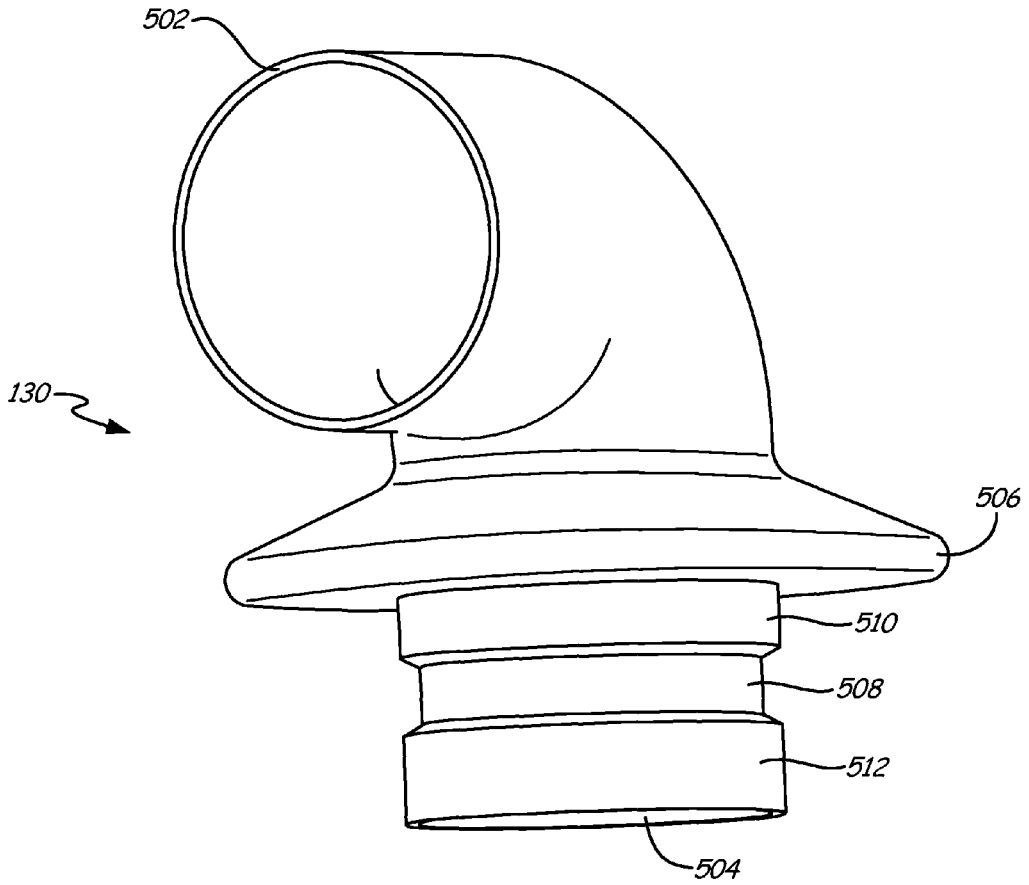
FIG. 5 is a perspective view of a swivel elbow.

FIG. 5 is a perspective view of swivel elbow 130 by itself. Swivel elbow 130 includes an inlet aperture 502 and an outlet aperture 504. The inlet aperture 502 illustratively receives material from the flexible tube 128 (shown and labeled in FIGS. 1, 2, and 4) and passes it to the inside of tank 102 (shown and labeled in FIGS. 1-4). Swivel elbow 130 may include a ledge portion 506 that is configured to rest upon tank 102. Around the outlet aperture 504, the swivel elbow 130 includes a portion 508 having a reduced thickness/diameter that is surrounded by two portions 510 and 512 having an increased thickness/diameter.

Figures 1, 6:
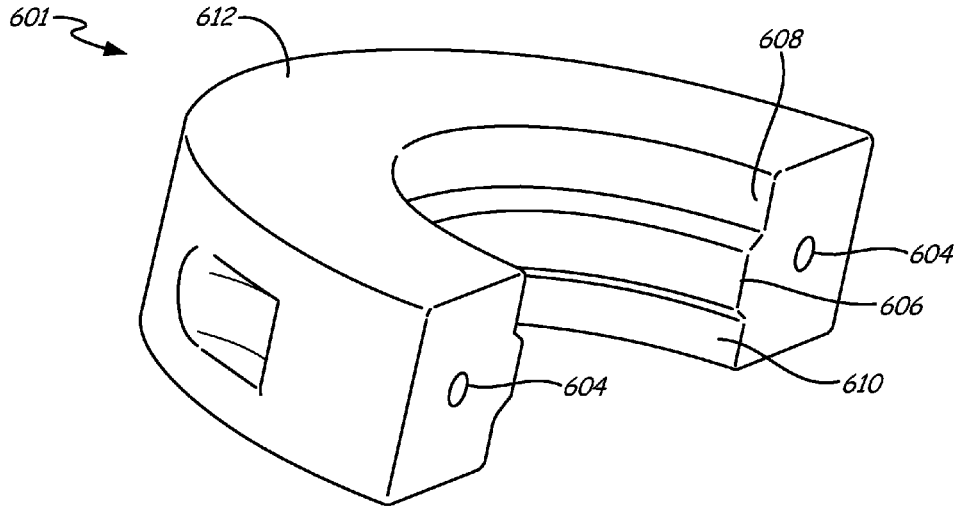
Figures 2, 6:
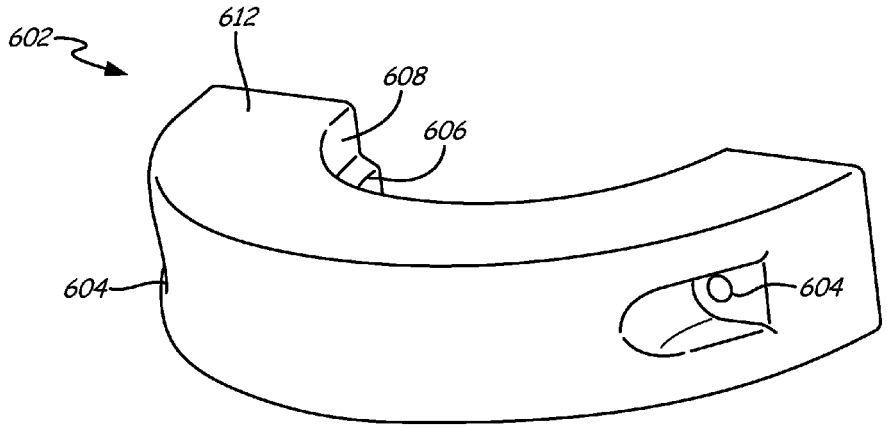

FIGS. 6-1 and 6-2 show two main portions 601 and 602 that join together to form a clamp ring 164 (shown and labeled in FIG. 4). In an embodiment, clamp ring 164 fits around swivel elbow 130 (shown and labeled in FIG. 5) to form an airtight seal between the swivel elbow 130 and tank 102. Accordingly, an airtight seal is formed between the swivel elbow 130 and tank 102.

Clamp ring portions 601 and 602 each optionally includes two apertures 604 that are configured to receive an attachment mechanism (e.g. screw, bolt, etc.) that holds portions 601 and 602 securely together. Clamp ring portions 601 and 602 may also include a portion 606 having a reduced thickness/diameter, and two portions 608 and 610 having an increased thickness/diameter. In an embodiment, clamp ring portions 601 and 602 clamp together around swivel elbow 130 such that portions 606 fit within portion 508 of swivel elbow 130, and portions 608 and 610 fit around portions 510 and 512 of swivel elbow 130. With clamp ring portions 601 and 602 around swivel elbow 130, a top portion 612 of the clamp ring works together with the ledge 506 of the swivel elbow 130 to form an airtight seal such that air does not leak into the tank 102 around the swivel elbow 130.

Figure 7:
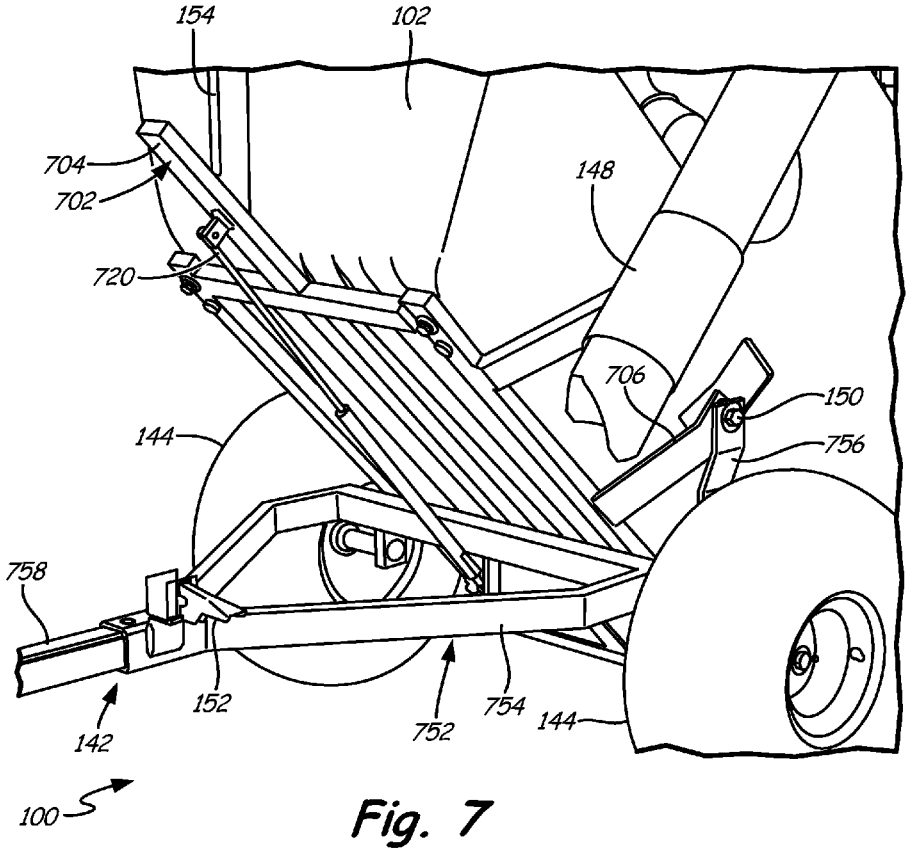
FIG. 7 is a perspective view of a tiltable frame assembly.

FIG. 7 shows a perspective view of vacuum system 100 with tank 102 tilted to the up or unloading position. The portable frame 142 illustratively includes an upper portion 702 and a lower portion 752. Upper portion 702 is optionally securely attached to tank 102 such that the position of upper portion 702 relative to tank 102 does not change. Upper portion 702 may include latch portion 704, T-bar 154, vacuum wand holder 148, and tilt attachment portion 706. Lower portion 752 may include triangular frame portion 754, tilt attachment portion 756, tongue portion 758, and spring-loaded latch 154.

The upper portion 702 and the lower portion 752 of the frame 142 are optionally connected together at attachment mechanisms 150 such that the two portions tilt relative to one another about an axis that runs through attachment mechanisms 150. Accordingly, the tilting point of the tank 102 is not at either one of its ends, but is instead at a middle portion of tank 102. This may in some situations make it easier to tilt tank 102. For instance, some of the material collected in tank 102 can be used to help tilt the tank up when the tilting point of tank 102 is towards the middle.

Upper portion 702 and lower portion 752 may also be connected together utilizing a gas cylinder 720. In one embodiment, the gas cylinder 720 assists an operator in tilting tank 102 up. Gas cylinder 720 can also help ensure that tank 102 is tilted back down in a smooth motion instead of slamming down.

Lower portion 752 optionally includes tongue portion 758 that may be connected to a hitch (e.g. hitch 146 shown in FIG. 1). Tongue portion 758 may be removable and placed within tank 102 during shipment. Lower portion 752 may also include a spring-loaded latch 152. In an embodiment, latch 152 holds onto upper latch portion 704.

Figure 8:
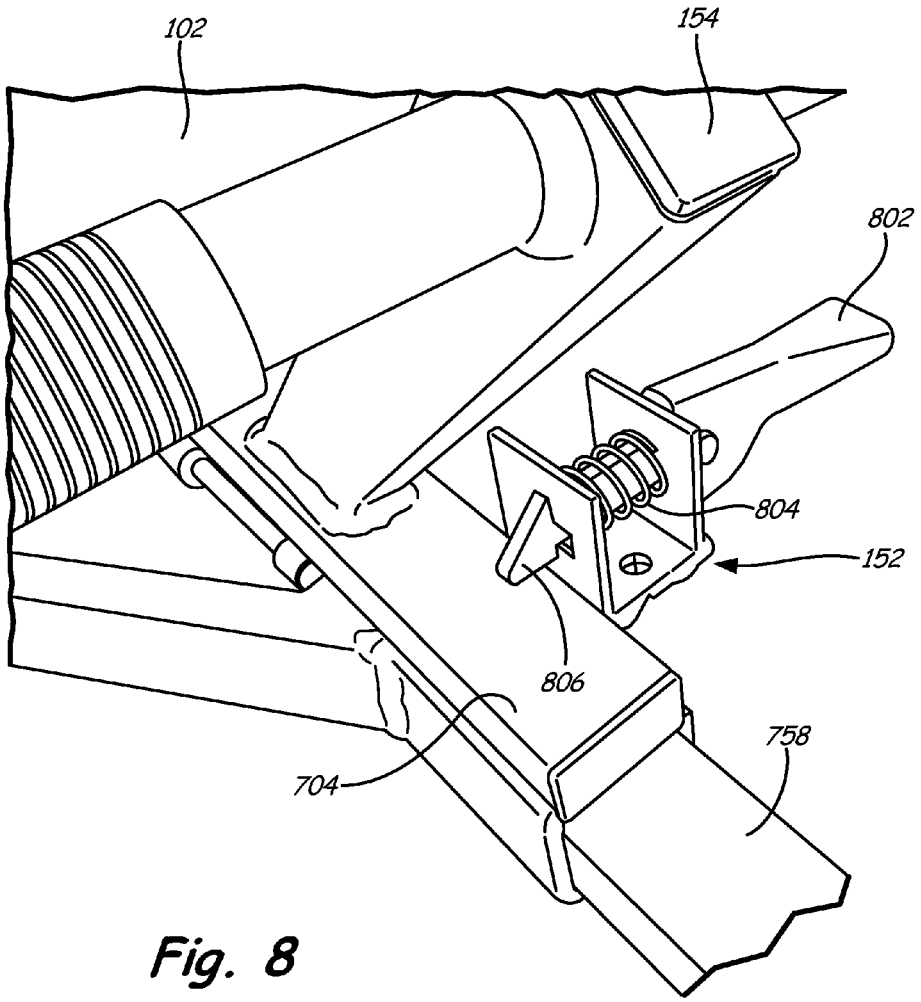
FIG. 8 is a perspective view of a spring-loaded latch assembly.

FIG. 8 is a close-up view of the spring-loaded latch 152. Latch 152 optionally includes a lever 802, a biasing spring 804, and a retractable bar 806. In one embodiment, biasing spring 804 biases retractable bar 806 outward into the position shown in FIG. 8. In the out position, bar 806 is able to catch and hold down latch portion 704, and thus hold tank 102 in the down or un-tilted position.

An operator can illustratively press lever 802 (e.g. foot or hand activated, etc.) which causes retractable bar 806 to be retracted. This enables latch portion 704 to pass by the latch 152, and for the tank 102 to move to the up or tilted position. Accordingly, latch 152 can be used to control the position (e.g. tilted or un-tilted) of tank 102.

Figure 9:
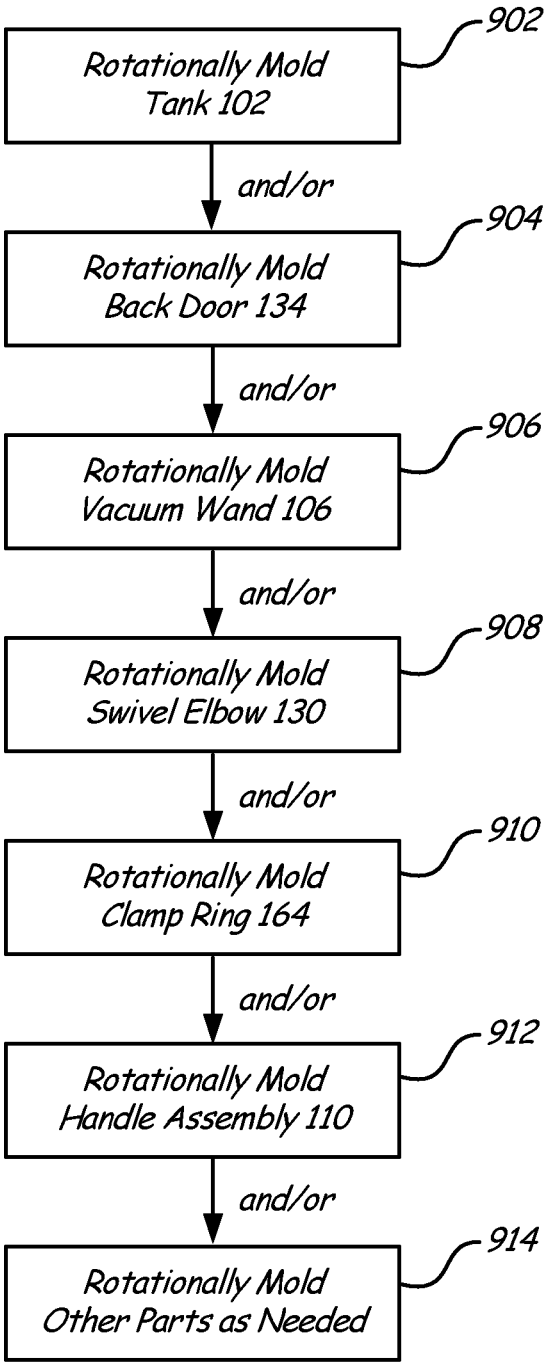
FIG. 9 is a block diagram of a method of making components of a portable vacuum system.

FIG. 9 shows a method of manufacturing some components of a portable vacuum system. In an embodiment, one or more components of a vacuum system are created by rotational molding. All of the parts can be rotationally molded at a same time, or the parts can be rotationally molded separately. As shown in the figure, any combination of one or more parts may be made by rotational molding. For instance, at block 902, tank 102 is rotationally molded. At block 904, back door 134 is rotationally molded. At block 906, vacuum wand 106 is rotationally molded. At block 908, swivel elbow 130 is rotationally molded. At block 910, clamp ring 164 is rotationally molded. At block 912, handle assembly 110 is rotationally molded, and at block 914, any other one or more parts is rotationally molded as needed.

Finally, it is to be understood that even though numerous characteristics and advantages of various embodiments have been set forth in the foregoing description, together with details of the structure and function of various embodiments, this detailed description is illustrative only, and changes may be made in detail, especially in matters of structure and arrangements of parts within the principles of the present disclosure to the full extent indicated by the broad general meaning of the terms in which the appended claims are expressed. In addition, although the embodiments described herein are directed to portable vacuum systems, it will be appreciated by those skilled in the art that the teachings of the disclosure can be applied to other types of systems, without departing from the scope and spirit of the disclosure.

What is claimed is:

1. A portable vacuum system comprising:
a tank;
an engine that is configured to generate a vacuum within the tank, wherein the engine is supported on a ledge such that a portion of the tank is below the ledge; and
a transportation system that has one or more wheels and that is configured to tilt the tank about an axis that is between a front and a back of the tank, wherein attachment mechanisms that attach the tank to the transportation system reinforce the tank to prevent collapsing.

2. The system of claim 1, and further comprising:
a swivel elbow that connects the tank to a vacuum wand.

3. The system of claim 2, wherein the swivel elbow is configured to rotate relative to the tank.

4. The system of claim 1, and further comprising:
a back door that forms a seal with the tank along a curved lip.

5. The system of claim 1, and further comprising:
a filter that is accessible through a threaded cover on the tank.

6. The system of claim 1, wherein at least some of the components are rotationally molded.

7. A portable vacuum system comprising:
a tank;
an upper frame portion that is connected to the tank;
a lower frame portion that includes wheels and that is rotatably connected to the upper frame portion at attachment points; and
a releasable latch mechanism that is configured to hold the upper frame and the tank in a down position.

8. The system of claim 7, wherein a volume of the tank is greater than or equal to 100 gallons.

9. The system of claim 7, wherein multiple components of the portable vacuum system are made utilizing rotational molding.

10. The system of claim 7, and further comprising:
a vacuum wand connected to the tank; and
one or more engine controls attached to the vacuum wand.

11. The system of claim 7, wherein the upper frame portion includes a vacuum wand holder.

12. The system of claim 7, and further comprising:
a gas powered engine.

13. The system of claim 7, and further comprising:
a hitch that is connected to the lower frame and that enables the portable vacuum system to be pulled.

14. The system of claim 7, and further comprising:
a rear door; and
a hinge that connects the rear door and the tank.

15. A portable vacuum system comprising:
a frame;

a hitch that is connected to the frame and that enables the frame to be pulled;

a tank that is mounted to the frame and that enables the tank to be tilted between an up and a down position, wherein attachment mechanisms that attach the tank to the frame reinforce the tank to prevent collapsing;

an engine that is mounted to the tank and that is configured to generate a vacuum within the tank; and a flexible tube that is connected to a top of the tank utilizing a swiveling elbow.

16. The system of claim 15, wherein the frame comprises an upper and a lower portion.

17. The system of claim 16, wherein the tank is connected to the upper portion.

18. The system of claim 15, and further comprising:

a back door that forms an airtight seal with the tank.

* * * * *